United States Patent [19]

Giocastro

[11] Patent Number: 4,603,663

[45] Date of Patent: Aug. 5, 1986

[54] ROCKERARM SYSTEM FOR CONTROLLING VALVES IN AN INTERNAL COMBUSTION ENGINE

[76] Inventor: Joseph Giocastro, 6428 Metropolitan Ave., Middle Village, N.Y. 11379

[21] Appl. No.: 547,435

[22] Filed: Nov. 1, 1983

[51] Int. Cl.[4] ..... F01L 1/34

[52] U.S. Cl. ..... 123/90.17; 123/90.41

[58] Field of Search ..... 123/90.15, 90.17, 90.18, 123/90.31, 90.33, 90.36, 90.39, 90.41, 90.44, 195 R

[56] References Cited

U.S. PATENT DOCUMENTS

| | | | |
|---|---|---|---|
| 1,293,712 | 2/1919 | Church | 123/90.44 |
| 1,311,060 | 7/1919 | Felix | 123/90.44 |
| 1,351,950 | 9/1920 | Gaston | 123/90.44 |
| 1,415,374 | 5/1922 | Lovejoy | 123/90.44 |
| 1,507,666 | 9/1924 | Davis | 123/90.44 |
| 1,521,440 | 12/1924 | Foster | 123/90.44 |
| 1,740,790 | 12/1929 | Stanton | 123/90.17 |
| 2,000,635 | 5/1935 | Edwards | 123/90.36 |
| 3,064,635 | 11/1962 | Rohrbacher | 123/90.41 |
| 3,146,767 | 9/1964 | Dadd | 123/90.36 |
| 3,179,094 | 4/1965 | Ribeton | 123/90.36 |

FOREIGN PATENT DOCUMENTS

| | | | |
|---|---|---|---|
| 649192 | 1/1951 | United Kingdom | 123/90.17 |
| 1230307 | 4/1971 | United Kingdom | 123/90.44 |

*Primary Examiner*—Craig R. Feinberg
*Assistant Examiner*—David A. Okonsky
*Attorney, Agent, or Firm*—Lackenbach Siegel Marzullo resta & Aronson

[57] ABSTRACT

A rocker arm system for internal combustion engines that directly position the top of the rocker arm in perpendicular operative contact with the valve stem of the cylinder head. The valve stem is angled toward the side wall of the cylinder block. The rocker arm is positioned along the side wall of the cylinder block and the cylinder head with the valve stem can be removed from the cylinder block without removing the rocker arm. The bottom end of the rocker arm is in operative contact with the cam of the camshaft. The bottom ends of rocker arms can be arced so as to straddle the camshaft. Gearing between the crankshaft and the camshaft to adjust the camshaft to upper and lower positions along a bottom arc of the camshaft so as to control the valve openings can be included.

3 Claims, 7 Drawing Figures

ROCKERARM SYSTEM FOR CONTROLLING VALVES IN AN INTERNAL COMBUSTION ENGINE

This invention relates to internal combustion engines and more particularly to rocker arm construction, with particular reference to the valve arrangement and construction of such engines.

The principal object of the present invention is to provide a generally upright rocker arm having a bend at the top end generally perpendicular to the valve.

Yet another principal object of the present invention is to provide a rocker arm having a bend at the top end which is perpendicular to the valve, wherein the valve rides back at an angle relative to the horizontal, the bend at the top end of the rocker arm being perpendicular to the valve.

Yet another principal object of the present invention is to provide a rocker arm having a bend at the top end which is perpendicular to the valve, wherein the valve rides back and forth at an angle approximately 30 degrees relative to the horizontal, the bend at the top end of the rocker arm being perpendicular to the valve.

Another principal object of the present invention is to provide a generally upright rocker arm with opposed bent ends in generally perpendicular contact with moving parts such as valves, camshafts and hydraulic lifters.

My invention relates to a valve operating mechanism for an internal combustion engine, and more particularly to a novel form of mechanism for increasing the valve lift or period of opening of the valves associated with the engine, the mechanism providing for a marked increase in power for the engine.

Another principal object of the invention is an improved rocker arm, wherein a generally upright rocker arm has a bend at the top end and an arc at the bottom end, wherein a camshaft straddles mating bottom arcs of the rocker arms of an embodiment of an V-engine so that less noise and better clearance are obtained, and the bends at the top of the rocker arms are perpendicular to the valves associated with the pair of rocker arms.

Another principal object of the invention is to provide an improved rocker arm, wherein the top end of the rocker arm forms a bend relative to the rocker arm so that the valve is perpendicular to the top portion of the rocker arm, so that the cylinder head can be removed from the engine without removing the rocker arm.

Another object of the invention is to provide an improved rocker arm that positions the camshaft relatively near the cylinder head and positions the valves at the top of the head relative to the rocker arm so that the cylinder head can be removed without removing the rocker arm.

Another object of the present invention is to provide a rocker arm having a bottom end arc that is spaced at the same distance from the camshaft during rotation of the bottom end arc relative to the camshaft.

Another object of the present invention is to provide a rocker arm that is actuated by either a manual or a governor control mechanism including a gear train of the type used in the art of actuating inlet and outlet valves of an internal combustion engine.

It is to be understood that in the drawings and detailed description of the invention following certain parts such as shown, keys, keyways, nuts, bolts, and other positioners and fasteners are to be applied in ways known in the art but are not shown in the drawings in every place where they would be used.

The rockerarm assembly described below has its parts identified by numbers or numbers with letters as indicating a modification of the part.

In order for the invention to be more fully understood, particular embodiments of the invention will now be described more fully purely by way of illustrative examples, with reference to the following accompanying drawings.

Figure 1:
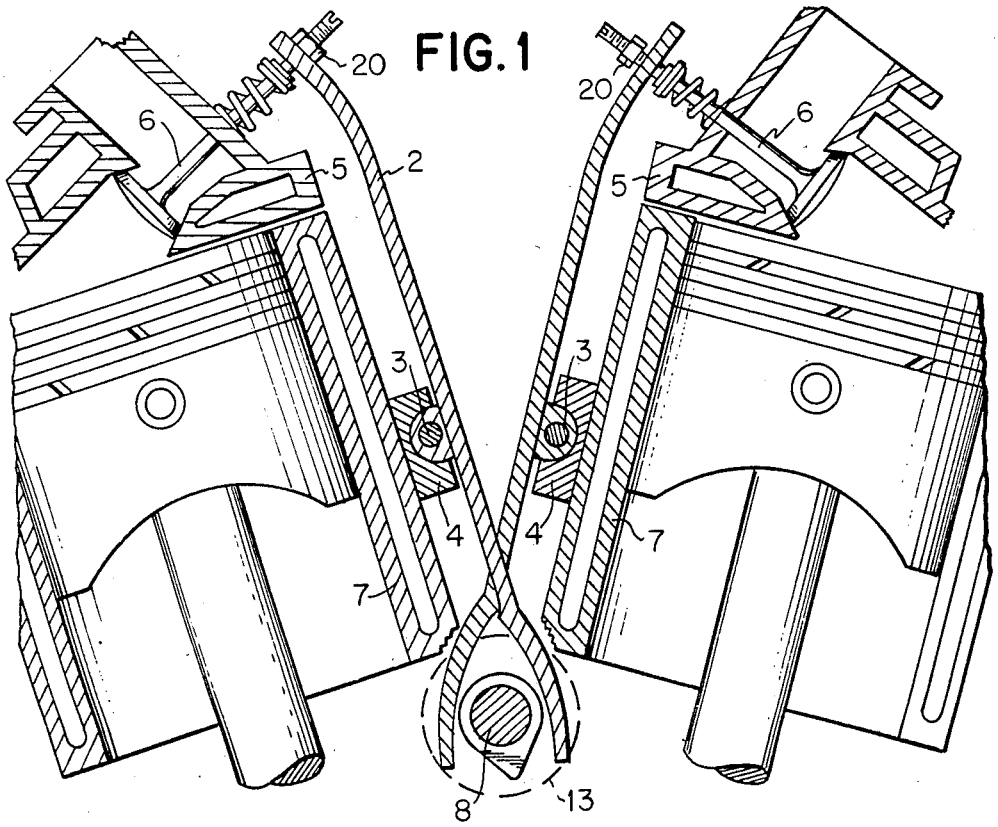
FIG. 1 is a sectional end view of a typical V-8 engine wherein the rocker arms are perpendicular to the valve and the bottom ends of the rocker arms straddle the cam.
Figure 2:
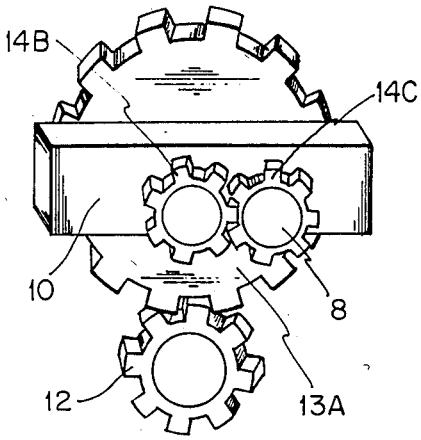
FIG. 2 is a perspective view of a swing bar mechanism for controlling the position of the cam relative to the arc portion of the rocker arm.
Figure 3:
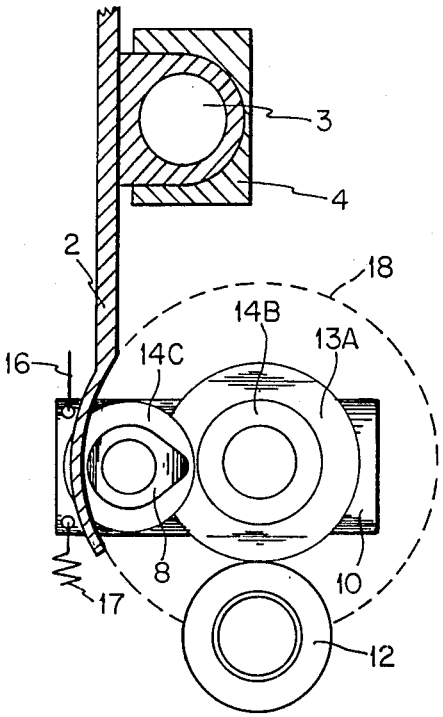
FIG. 3 is a diagrammatic view of the swing bar mechanism of the gear train shown in FIG. 2 with a dotted line showing the arc around the cam and the arc of the bottom end of the rocker arm.

In the drawings, there is shown by way of example a rocker arm assembly with control mechanisms according to the present invention. FIG. 1 illustrates a generally upright rocker arm 2 having a top end in contact with a valve stem 6. The bottom end of rocker arm 2 is in association with camshaft 8, which can be used in conjunction with 4, 6, or 8 cylinders. The embodiment shown in FIGS. 2 and 3 is used in conjunction with a 4 cylinder engine. A mounting body 4 is secured to the inner side of an engine block 7. A rocker arm shaft 3 is connected to mounting body 4 while rocker arm 2 is rotatably connected to rocker arm shaft 3 at a projection from the rocker arm. The bottom of the rocker arm is arced and rides on the cam of cam shaft 8. The top of rocker arm 2 rides on the stem of valve 6. An adjustment nut and bolt unit 20 is shown at the top of rocker arm 2. FIG. 1 illustrates two engine units in a V-engine configuration as representative of a multi-cylinder engines, such as a V-6 or V-8 engine.

FIG. 2 illustrates a timing gear train mechanism for controlling the movement of camshaft 8. Crankshaft gear 12 meshes with idler gear 13A, which in turn is secured to a small gear 14B, which in turn is keyed to idler gear 13A so that both gears 13A and 14B each turn once in spite of the different sizes of the gears. Gear 14B in turn meshes with gear 14C, which is unitary with camshaft 8. With the aid of swing bar member 10, gear 14C, with camshaft 8, moves back and forth in a circular arc around gear 14B.

When swing bar member 10 and the cam portion of camshaft 8 is at the far end of the arc of rocker arm 2, the opening allowed by valve 6 is less than when swing bar 10 is spaced from the end of the arc of the bottom end of rocker arm 2. This movement to control the relative size of the valve opening as to greater or smaller openings is timed to allow the inlet of air or the outlet of the exhaust respectively. The gear train mechanism is timed to turn two times on crankshaft gear 12 to one time on camshaft gear 14C. This completes the function illustrated in FIG. 2.

FIG. 3 is a diagrammatic view of the gear train mechanism shown in FIG. 2 showing swing bar 10 in operation with the arc end of the bottom rocker arm 2. The arc followed is shown by dotted circle 18 about gears 13A and 14B is followed by the cam or camshaft 8. Swing bar member 10 moves back and forth from one end of the arc to the other end of the arc of rocker arm 2, thus creating distance changes between rocker arm 2 and the cam on camshaft 8 (without changing the clearance between the rocker arm and valve), which cause the variations any top objectionable valve noise in the openings allowed by valve 6 as discussed above.

Figure 4:
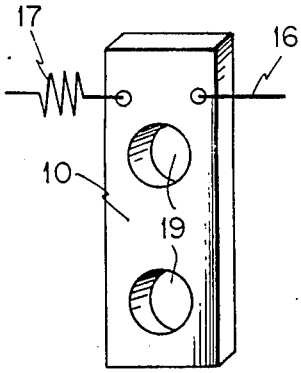
FIG. 4 is a perspective view of the swing bar mechanism shown in FIG. 3 for swinging around an idle gear shaft maintaining an arc movement that in turn is along the arc of the camshaft, wherein two or more swing bars keep the camshaft in line.

FIG. 4 shows swing bar 10 in an upright position with two openings 19, with upper opening 19 adapted to rotatably position camshaft 8 and lower opening 19 adapted to rotatably position the shaft for idler gear 13A. A small opening shown above opening 19 is adapted to position a back spring 17 for pulling camshaft 8 back from a non-upright position to the upright position shown. Another small opening above the upper opening 19 is adapted to anchor a pull bar 16, which is used for pulling swing bar 10 forth into position until it is needed in accordance with manual or governor operation.

Figure 5:
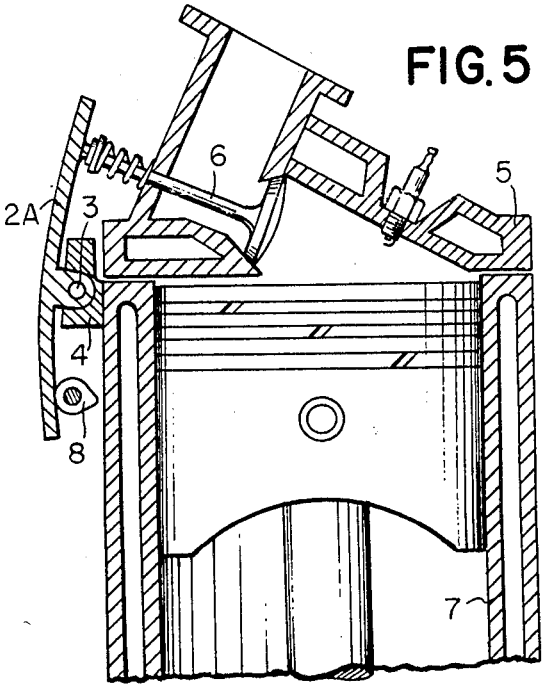
FIG. 5 is a sectional end view of an arced rocker arm and a view of the cylinder head and its valves, wherein the cylinder head can be removed without removing the rocker arm.

FIG. 5 is a modified form of a rocker arm according to to the present invention. A short, arced rocker arm 2A is adapted to operate overhead valves 6 with cylinder head 5. Support body 4 is secured to the surface of cylinder block 7. A rocker arm shaft 3 secured to support body 4 is adapted to rotatably connect upwardly extending rocker arm 2A to support body 4. Rocker arm 2A rides valve 6 and the cam of camshaft 8, with the top of rocker arm 2A having an inward bend adapted to ride shaft 6 at the perpendicular.

Figure 6:
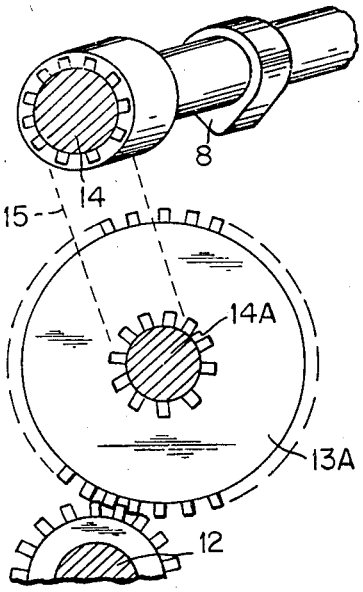
FIG. 6 is a perspective view of a gear train along with a timing chain from camshaft gear to idler gear that is used in association with FIG. 5.

FIG. 6 illustrates a mechanism to operate a sprocket gear 14 which is attached to camshaft 8. A timing chain 15 extends between sprocket gears 14 and 14A. Sprocket gear 14A is attached to idler timing gear 13A. An idler timing gear 13A meshes with crankshaft gear 12 so that two turns of crankshaft gear 12 results in one turn of sprocket gear 14A.

Figure 7:
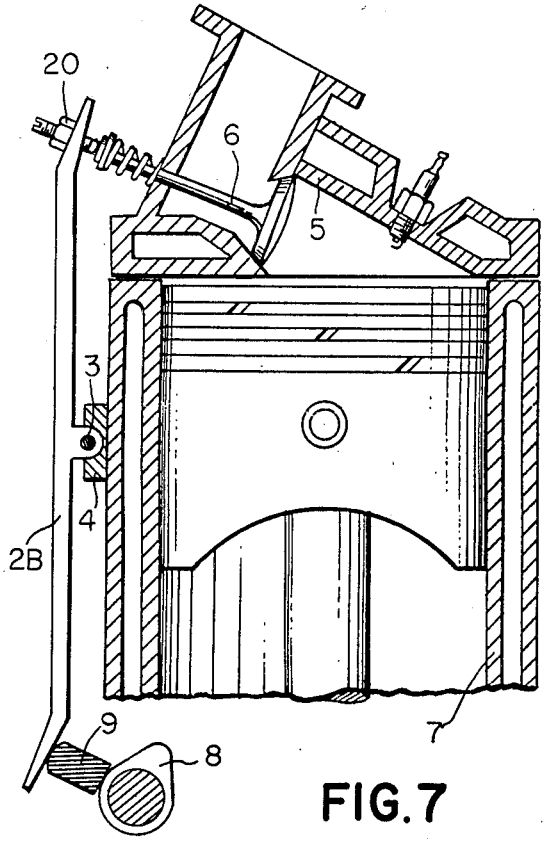
FIG. 7 is a sectional end view of a hollow tubular type rocker arm including the angled cylinder head and angled valve and also including a hydraulic lifter between the valve and the rocker arm.

FIG. 7 illustrates yet another embodiment of the present invention. A hollow, tubular rocker arm 2B has an upper bend at its top end so as to make a face to ride valve 6 of cylinder head 5 at the perpendicular. The lower end of rocker arm 2B has a lower bend that forms a face adapted to ride on the cam of camshaft 8. A hydraulic lift 9 is disposed between rocker arm 2B and camshaft 8. Support body 4 is secured to cylinder block 7 and rocker arm shaft 3 mounted to support body 4 rotatably supports rocker arm 2B. Rocker arm 2B includes a channel adapted to contain oil. Approximately three pin holes at the touching parts of the upper and lower bent ends of rocker arm 2B are adapted to pass oil from the channel of rocker arm 2B so as to lubricate the touching parts at valve 6, at hydraulic lift 9. Oil enters the channel of rocker arm at shaft 3. An adjustment nut and bolt mechanism 20 is positioned at the top end of rocker arm 2B.

The design of the vertical rocker arm and the gear train adjusting mechanism heretofore described is given merely by way of illustration and is not intended to limit the scope of this invention which is limited only by the scope of the appended claims.

What is claimed is:

1. A rocker arm system for an internal combustion engine, comprising, in combination, at least one engine unit including a cylinder block having a top side and an opposed bottom side and a side wall extending between said top and bottom sides, a cylinder head mounted to said top side of said cylinder block, valve means seated in and operatively connected to said cylinder head and movable between open and closed positions, said valve means including biasing means for moving said valve means from said open position to said closed position, said valve means including a valve stem, said valve stem having a stem end and extending to said side wall of said cylinder block, said valve means entering said cylinder head from a position above said cylinder head, cam means positioned proximate to said side wall of said cylinder block, arm means rotatably connected to said side wall of said cylinder block and extending between and operatively positioned relative to said cam means and said valve means, said arm means being movable between first and second positions, wherein in said first position said arm means is free of pressure contact with said cam means and said valve means, and in said second position said arm means is in pressure contact with said cam means and with said valve means wherein said valve means has been moved to said open position by said arm means, said arm means being movable from said second position to said first position by said biasing means of said valve means upon release of said arm means from said second position by said cam means, said arm means including an arm member having opposed top and bottom end portions, said arm member being substantially straight in structure and substantially parallel to said side wall of said cylinder block, said top end portion having a bend portion configured to be in perpendicular operative contact with said stem end of said valve stem, mounting means secured to said side wall of said cylinder block for rotatably connecting said arm means to said cylinder block for movement between said first and second positions, a crankshaft driven by the piston of said cylinder block positioned proximate to said bottom side of said cylinder block, gearing means associated with said crankshaft and with said crankshaft for moving said cam means between said first and second positions so as to operate said arm means and said valve means in timed sequence for operation of said engine.

2. A system in accordance with claim 1, wherein said at least one engine unit includes a plurality of engine units.

3. A system in accordance with claim 2, wherein said cam means includes a camshaft and a cam portion extending from said cam shaft, said bottom end portion of said arm member being configured as an arc portion, said arc portion being in operative contact with said cam portion during rotation of said camshaft so that said arm member is rotated from said first position to said second position, said plurality of engine units being at least two engine units disposed in a V-engine configuration, said cam shaft being positioned midway between the cylinder blocks of said two engine units, the bottom end portions of the two arm members of said two engine units being configured in concave mating arc portions, said camshaft being disposed between said mating arc portions, said cam portion being capable of alternately striking each of said mating arc portions in timed sequence so as to move each of said arc portions from said first position to said second position, said camshaft being positioned proximate to said bottom side of said cylinder block and to said crankshaft, said camshaft being capable of being rotated back and forth in an arc path by said gearing means, said bottom arc portions of said arc members having upper and lower areas relative to said cylinder block; and further including camshaft positioning means connected to said camshaft for selecting an upper or a lower position relative to said bottom arc portion, said bottom arc portion being concentric with said arc path of said camshaft, said cam portion of said camshaft being capable of striking said upper area when said camshaft is selected to be positioned in said upper position and is capable of striking said lower area when said cam shaft is selected to be in said lower position.

* * * * *